United States Patent [19]

Piazza

[11] 4,233,787

[45] Nov. 18, 1980

[54] COMPOSITE BUILDING MODULE AND METHOD FOR MAKING SAME

[75] Inventor: Matthew R. Piazza, Nichols, Conn.

[73] Assignee: Maso Therm Corporation, Bridgeport, Conn.

[21] Appl. No.: 925,251

[22] Filed: Jul. 17, 1978

[51] Int. Cl.[3] ..... E04G 21/12

[52] U.S. Cl. ..... 52/125; 52/602; 52/380; 52/576; 52/577

[58] Field of Search ..... 52/125, 381, 576, 577, 52/612, 659, 221, 602, 380–383; 264/34, 35

[56] References Cited

U.S. PATENT DOCUMENTS

| | | | |
|---|---|---|---|
| 1,526,359 | 2/1925 | Michie | 52/125 |
| 2,887,868 | 5/1959 | Glidden | 52/381 |
| 3,229,437 | 1/1966 | Adie | 52/576 |
| 3,852,930 | 12/1974 | Naaman | 52/659 |
| 3,908,323 | 9/1975 | Stout | 52/221 |
| 4,069,629 | 1/1978 | Piazza | 52/125 |

FOREIGN PATENT DOCUMENTS

| | | | |
|---|---|---|---|
| 2231060 | 1/1974 | Fed. Rep. of Germany | 52/125 |

*Primary Examiner*—James L. Ridgill, Jr.

*Attorney, Agent, or Firm*—Sprung, Felfe, Horn, Lynch & Kramer

[57] ABSTRACT

A composite building module and method for making same including forming a bottom layer of fiber reinforced wet cementitious material, placing at least two rigid foam cores side by side on the bottom layer with the adjoining edges configured to define a channel around adjoining cores and encapsulating the cores in a fiber reinforced wet cementitious shell by depositing fibers on cementitious material around the sides of the cores and on the top thereof, wherein each channel is filled in to form a rib around the interior of the cementitious shell.

21 Claims, 15 Drawing Figures

COMPOSITE BUILDING MODULE AND METHOD FOR MAKING SAME

BACKGROUND

This invention relates to an improvement in composite modules especially those useful in building applications which is similar to monolithic cast concrete modules in outward appearance and use, yet has significant improvements in insulating properties and weight reduction. More particularly, this invention relates to large size composite modules having at least two connected rigid foam cores encapsulated in a shell of fiber reinforced cementitious material having ribs around the interior of the shell and a method for making such a module.

Because of increased costs in material and labor, the construction industry has come to use prefabricated building modules, for example wall panels, roof decks and the like. A popular form of construction is known as "curtain-wall" construction and involves the use of a structural steel skeleton to which prefabricated or precast panels are attached. Such curtain-wall panels are commonly cast from reinforced concrete and are provided with a surface finish such as a smooth concrete finish or aggregate imbedded into the face of the panels. These panels are extremely heavy. For example, a four foot by eight foot curtain-wall panel cast from reinforced concrete weighs from about 1,400 to 1,600 pounds and requires heavy construction equipment to install. In addition, these panels provide very poor insulating properties and by themselves are a very poor vapor barrier. This makes necessary further construction to insulate and seal the pre-cast concrete curtain-wall.

The construction industry has long sought improved building elements that will offer advantages in material and construction costs.

The present invention provides a large size monolithic-like building module which is extremely light in weight as compared to pre-cast concrete panels for example and which has greatly improved insulating and vapor barrier properties per se.

SUMMARY OF THE INVENTION

The composite panel-like building module of the present invention has at least two rigid foam cores, disposed side-by-side, for example rigid polyurethane foam having a density in the range of 2 to 5 pounds per cubic foot, encapsulated in a shell of fiber reinforced cementitious material having reinforcing ribs around the interior thereof for example at the juncture between cores. The cementitious shell is also reinforced with a first fibrous reinforcing material in discrete fiber form distributed in an interconnected random matrix substantially throughout the shell. A second fibrous reinforcing material in scrim form may also be disposed around the foam cores and adjacent the shell.

The composite module is made according to the present invention by forming a bottom layer of fiber reinforced wet cementitious material, placing at least two rigid foam cores side-by-side on the bottom layer with the adjoining edges configured to define a channel around adjoining cores and encapsulating the cores in a fiber reinforced wet cementitious shell by depositing fibers and cementitious material around the sides of the cores and on the top thereof, wherein each channel is filled in to form a rib around the interior of the cementitious shell.

The bottom layer can be formed by depositing a premix of cement and files (e.g. ½" long) and/or by distributing lengths of fiber longer than the premixed fibers. The space around the core is filled with a premix of cement and fibers and vibration can be used to help fill the space.

The cores may be connected by wrapping scrim material therearound by tieing bands around the outside thereof or by interlocking the adjoining sides.

The cores are preferably rectangular solids which have hollow centers in order to reduce the weight thereof and have male and female interlocking elements on opposite longitudinal sides.

The interlocking elements may have one of a rectangular or semicircular cross-section with the female interlocking elements configured to interlock with the male interlocking element on the adjoining core.

The means for forming the channel comprises a bevel on the adjoinable edges having one of a concave, slanted or stepped cross-section. The channel can also be formed in the walls of the cores rather than at adjoining cores.

The cores may be placed in a mold with the longitudinal axis running parallel to or perpendicular to the direction in which the cementitious material is deposited therein.

BRIEF DESCRIPTION OF THE DRAWINGS

The present invention will be more fully understood from the following description taken in conjunction with the accompanying drawings wherein.

DETAILED DESCRIPTION OF THE PREFERRED EMBODIMENTS

Referring now to FIGS 1–5, the composite module of the present invention comprises at least two rigid foam cores 10 having scrim reinforcing material 14 wrapped at least partly therearound and a rigid encapsulating shell 12 comprising fiber reinforced cementitious material.

Figure 1:
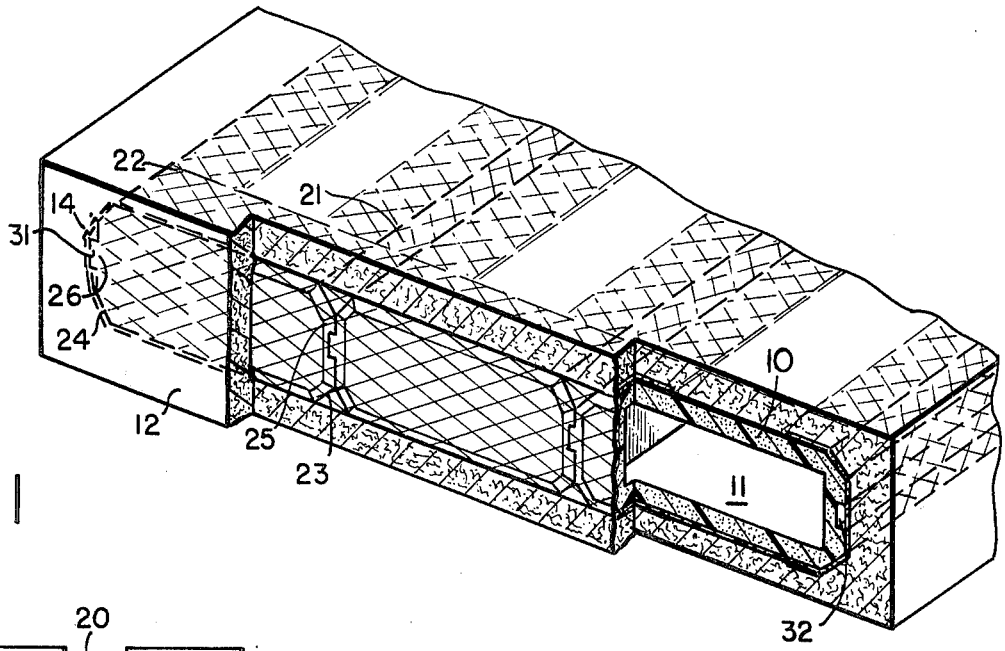
FIG. 1 is a perspective view partly broken away of one embodiment of the composite module according to the present invention.
Figure 3A:
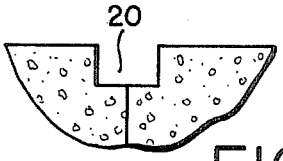
FIGS. 3*a–b* are detailed views of alternate embodiments of the channel forming means.
Figure 3B:
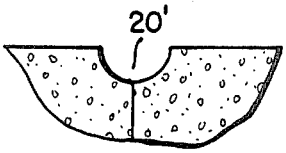
Figure 4:
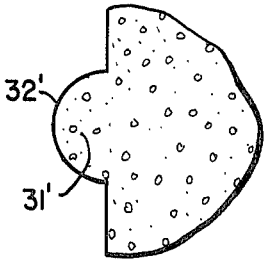
FIG. 4 is a detailed view of an alternative embodiment of the interlocking means.
Figure 2:
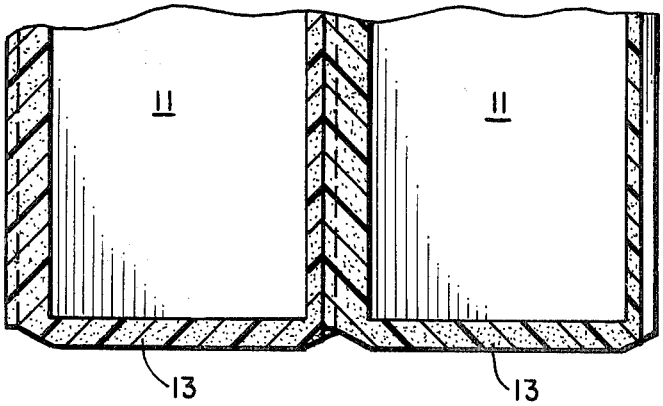
FIG. 2 is a top view of the adjoining cores of FIG. 1.

Each rigid foam core is preferably a hollow rectangular box comprising a hollow tubular central portion 11 and two flat end covers 13 connected thereto by adhesive or by liquid foam. (FIG. 2) The tubular portion 11 may be molded in the tubular shape or may be constructed by adhering flat sections of rigid foam together. Each foam core 10 includes a channel forming means in the walls or at edges 21–24 and optionally at edges 25 and 26 thereof. The channel forming means at these edges comprises a bevel therein which is shown in FIG. 1 to have a slanted cross-section, in FIG. 3*a* to have a stepped cross-section and in FIG. 3*b* to have a concave cross-section.

The channels are preferably formed at the edges, since the resulting depth thereof can be greater at this location. When the channels are placed in the walls, the lowest point can extend only approximately ½ to ¾ of the thickness of the wall without severly weakening same, while a channel formed at the edge, can achieve a depth of greater than the wall thickness, as shown in FIG. 1.

Of course any alternative cross-section which would bring about the same result could be used. As a result of the configuration of edges 21–26, when the cores 10 are placed side-by-side, a channel 20, 20' is formed therearound which can be filled with cementitious material. When filled with cementitious material, a reinforcing rib having the same cross-section as the channel, is formed on the interior of the cementitious shell 12 around each pair of adjoining cores.

Means are also provided for connecting the foam cores in the side-by-side relationship. As shown in FIG. 1, interlocking means can be used including a male interlocking element 31 and a female interlocking element 32 disposed on opposite sides of each core. In the preferred embodiment wherein the core is a rectangular solid, the male and female interlocking elements are preferably disposed on opposite longitudinal faces thereof and extend along substantially the entire length thereof. The female interlocking element is configured to tightly receive the male interlocking element to hold the cores in position. As shown in FIG. 1, the male interlocking element 31 and the female interlocking element 32 have a rectangular cross-section while an alternative embodiment shown in FIG. 4 the male interlocking element 31' and the female interlocking element 32' have a semicircular cross-section. The interlocking element 32 at the outside edge of the panel forms a rib therealong.

Figure 6:
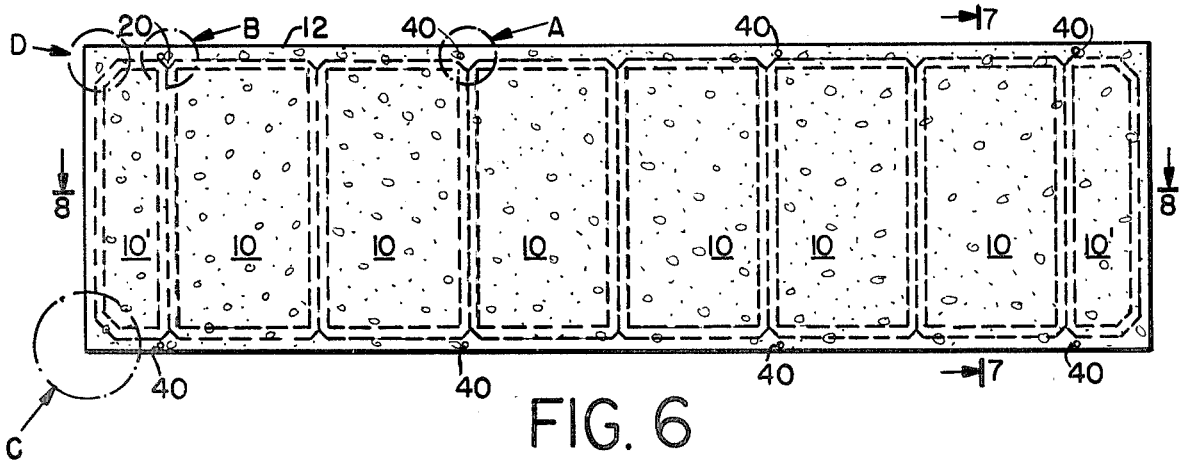
FIG. 6 is a top view of a further embodiment of the present invention.
Figure 8:
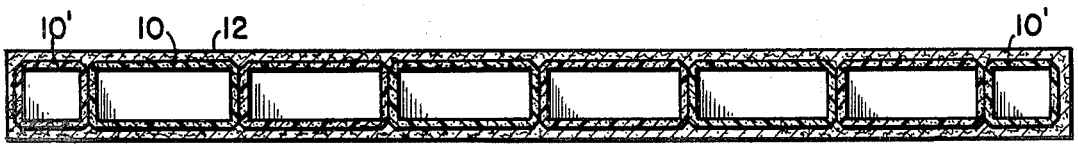
FIG. 8 is a side view of FIG. 6 along line 8—8.
Figure 7:
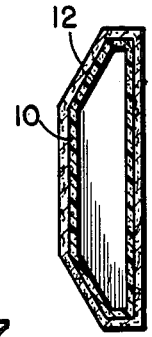
FIG. 7 is a side view along lines 7—7 of FIG. 6.
Figure 5:
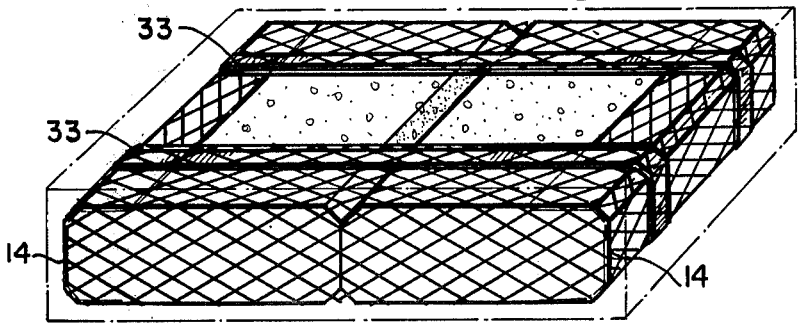
FIG. 5 is a perspective view of the module being produced according to the present invention.

An alternative embodiment of the means for connecting the cores together are bands 33 shown in FIG. 5. Furthermore, the cores may be held together by wrapping scrim material 14 therearound and the scrim material may also be used in addition to the interlocking means or the bands 33. In a further embodiment, six hollow cores 10 of one size are placed side by side with two end cores 10' of different size disposed at the ends thereof. The side by side cores 10 and 10' define channels 20 therearound as shown in FIGS. 6–8. As shown in FIG. 7, the cores and corresponding glass reinforced cement (GRC) shell 12 have a cross-section similar to that of a boat hull and this is utilized as an exterior wall for utilitarian and esthetic purposes.

In the embodiments shown in FIGS. 6–8, each of the larger cores are about eight and a half feet by four feet by one and three quarter feet, with the thickness of the foam being about one and a half inches. The GRC layer therearound is approximately one and an eighth inches at the ends and three inches at the sides and about one and an eighth inches at the top and bottom.

In order to remove these building modules which can be of significant size, from the mold, lifting members 40 are embedded in the shell 12. The inserts can also be used for subsequent handling of the modules.

Figure 9:
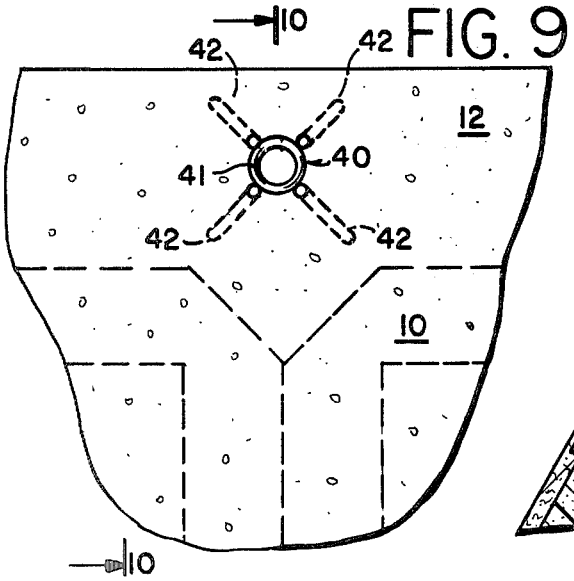
FIG. 9 is a detailed view of the area encircled by circle A in FIG. 6.
Figure 10:
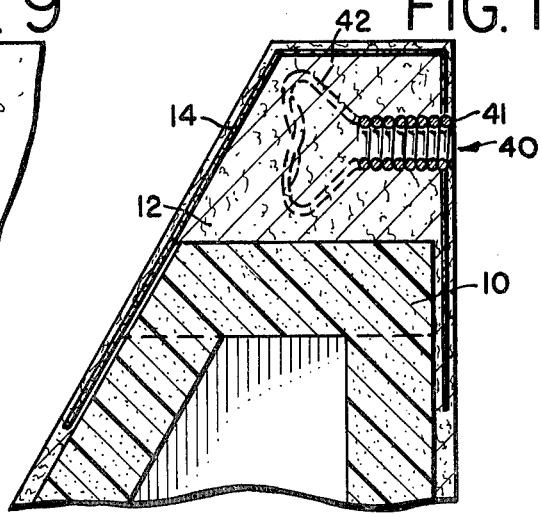
FIG. 10 is a view along line 10—10 of FIG. 9.

FIG. 9 shows a detailed view of one embodiment of the lifting member 40. The lifting member 40 is shown in FIGS. 9 and 10 as comprising a plurality of arms 42 which are embedded in the shell and a threaded end portion 41 which is flush with the outer surface of the shell 12. Lifting inserts of this type are described in U.S. Pat. No. 4,069,629.

Figure 11:
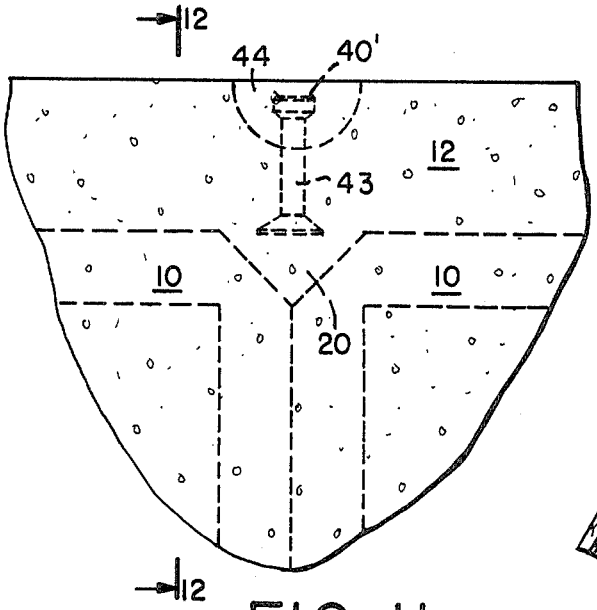
FIG. 11 is a detailed view of the area encircled by circle B in FIG. 6.
Figure 12:
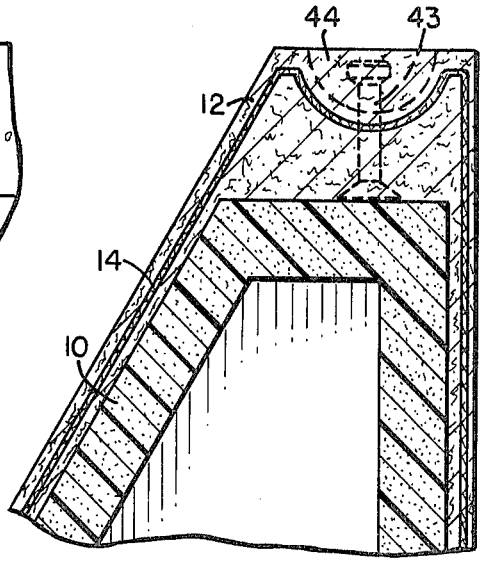
FIG. 12 is a view along line 12—12 of FIG. 11.

FIGS. 11 and 12 show an alternative embodiment of an insert 40' which in the side wall which can be used to invert, move and mount the modules. Insert 40' comprises an eye shaped member 43 having a lower portion embedded in the shell and an upper portion disposed in a semi-spherical cut-out 44 so that it can be accessed when desired by lifting means for lifting the module.

Figure 13:
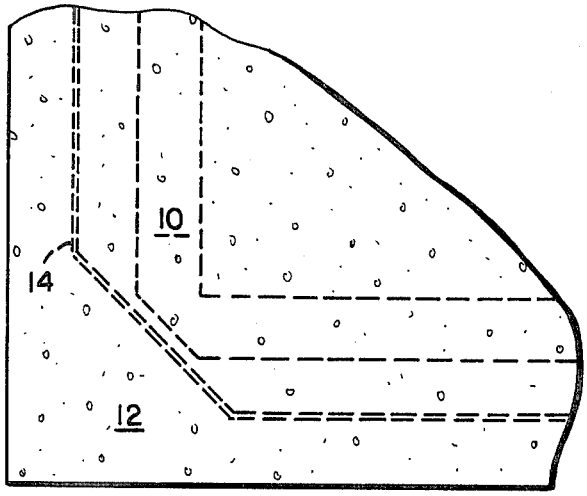
FIG. 13 is a detailed view of the area encircled by circle C in FIG. 6.
Figure 14:
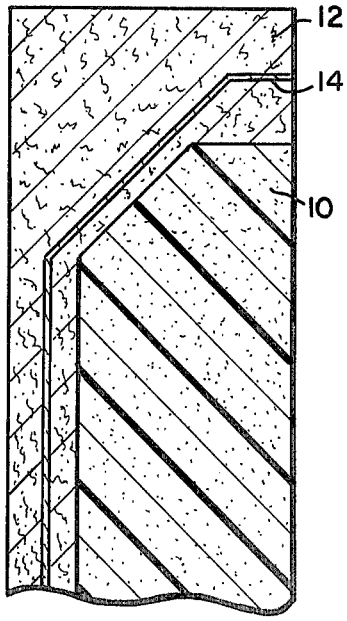
FIG. 14 is a detailed view of the area encircled by circle D in FIG. 6.

FIGS. 13 and 14 show additional details of the corners of the module of FIG. 6, wherein it is shown that scrim 14 is wrapped around the corners of the shell to provide further reinforcing strength thereto.

When the hollow cores are placed connected together on the bottom layer in a mold 18 as shown in FIG. 5, the longitudinal axes of the hollow portions may be either disposed perpendicular to or parallel to the direction in which the cementitious material is deposited thereover.

In a preferred embodiment, the cementitious material is reinforced with a glass fiber and the scrim reinforcing material is coated glass fiber scrim, while the rigid foam core is polyurethane foam.

The composite module is preferably a panel-like building module. The cementitious material is reinforced with fibrous reinforcing material in discrete fiber form which is preferably in two different fiber lengths. The shorter fibers are distributed in an interconnected random matrix throughout the shell 12, while the longer fibers are distributed in an interconnected random matrix together with the shorter fibers in the major surface portions of 12.

The combined use of short and long fibers has processing advantages in that the shorter fibers can be premixed with the cementitious material and the longer fibers can be deposited, for example, by cutting and chopping, in situ, during formation of the shell. This, together with the use of scrim reinforcing material 14 provides excellent reinforcing for the shell plus efficient processing. The premixed shorter fibers can be from about ¼ to about ¾ of an inch in length preferably about ½ inch in length, and are present in an amount from 1 to 3% by weight, preferably about 2% by weight, based on the weight of the wet cement. The longer fibers which are preferably chopped and deposited during formation of the major surface portions of the shell 12 can be made up to 3 inches in length, preferably about 2 inches in length and are present in an amount of from about 1 to about 3% by weight, preferably about 2% by weight, based on the weight of the wet cementitious material. The total recommended amount of fibrous reinforcement in GRC is about 5% by weight. When using both the shorter and longer fiber form and the scrim form it has been found that this can be reduced to about 3–4% by weight while still retaining the desired strength characteristics for the completed module.

The cementitious material is allowed to cure and the module is removed from mold 21 in the form such as is shown in the partially cutaway perspective view of FIG. 6.

The term "scrim" is used herein to include woven non-woven fibers and can be course or fine so long as it is sufficiently open to allow the foam cementitious mixture to penetrate and wet the scrim layer itself. Generally the scrim reinforcing material will have a screen like appearance with openings as small as an eighth of an inch up to two inches or more, preferably with openings of about a quarter of an inch up to one inch. Naturally, the type and the configuration of the scrim reinforcing material will depend on the ultimate use for the module being produced. For example for roof deck panels or curtain-wall panels measuring approximately five by ten feet and four inches thick, a single layer of scrim with openings of approximately one half inch surrounding the foam core or adjacent to the major surfaces or around the edges has been found to provide adequate reinforcement for these particular applications.

The fibrous reinforcement in fiber form is preferably glass fiber chopped from rovings in lengths of one quarter to three inches and preferably from one to two inches. A preferred glass fiber is AR(alkali resistant) glass fiber sold under the trademark CEM-FIL and more particularly described in U.S. Pat. No. 3,901,720 issued Aug. 26, 1975.

Because of availability and cost, the preferred fibrous reinforcement (both short and long fibers) is glass fiber and preferably AR glass fiber, and the scrim reinforcing material is preferably a glass fiber scrim such as E glass fiber scrim coated to impart alkalai resistance to the glass for example with a polyester coating. However, other similar and equivalent fibrous materials can be used for the fibrous reinforcing materials within the context of the present invention. For example, the fiber and/or scrim reinforcing materials can be the same or different and can be made from aramid fiber such as KAVLAR by DuPont, AR glass such as described above, nylon fibers, polyester fibers, and the like including natural and synthetic inorganic and organic fibers, for example graphite fibers. The scrim can also be made of a combination of fibers such as glass fiber and aramid fiber.

The cementitious material is preferably common cement in admixture with conventional fillers such as sand or pumice and can contain conventional additives such as lime and stearates for water resistance, latex for added strength and wetting ability with respect to the fiber reinforcement, and water reducing agents such as "Pozzilith" for quick setting. Conventional tints or dyes can also be used to provide the desired coloration.

It is also possible to use as a cementitious material a sulfur based product marketed under the trademark SUMENT by Chevron Chemical Company. This sulfur based material can be used in admixture with sand or other conventional fillers following known techniques for handling this type of material.

The glass fiber reinforcement can be incorporated into the cementitious material in an interconnected random matrix by premixing and/or by successively applying wet cementitious material and chopped and sprayed glass fiber. With conventional GRC where the glass content is generally about five percent by weight, premixing of the glass and cement is generally not possible without disturbing or destroying the glass fiber matrix. However, it is possible to premix and preserve the glass fiber matrix when using less glass for example two percent by weight glass. The present invention thus provides an additional advantage in being able to use a premix of wet cement and glass fibers preferably in combination with longer chopped and sprayed fibers.

Mechanical treatments can also be employed to work the glass fiber matrix into the wet cement mixture. For example rollers made of wire, grid or mesh can be applied to the mixture of glass fiber and cement and/or the scrim reinforcing material to insure thorough wetting of the reinforcing materials by the cement. The use of dilute latex can also assist in the wetting operation.

Suitable rigid foams include inorganic and organic foams. Rigid urethane polymer foams are preferred. These well known materials are widely used principally for insulation purposes. Urethane polymer foams are commonly formed by combining the reactants (a polyol and an isocyanate) using airless spraying or liquid application techniques. Foaming commences almost instantaneously and is completed within a very short period of time depending on the type of urethane polymer composition employed. The density of rigid urethane foams also depends on the nature of the urethane composition employed but generally ranges between about 1.5 pounds per cubic foot to 10 pounds per cubic foot, more commonly from 2 to 5 pounds per cubic foot. Other suitable rigid foams include polyester foams, phenolic resin foams, isocyanurate foams and sulfur based foams marketed under the trademark SUFOAM by Chevron Chemical Company.

It is preferred to form the cement glass fiber matrix by successively depositing chopped glass fibers and wet cement (preferably premixed with shorter glass fibers). This insures complete wetting of the glass fibers by the cement without disturbing the glass matrix and also thorough filling of the free space between the core and the sides of the mold.

A preferred process of forming the bottom layer of the shell is by successfully depositing a premix of wet cementitious material and fibers and individual fibers longer than the premixed fibers. For example, wet cement premixed with one half inch glass fibers can be applied in the desired thickness and then chopped and sprayed glass fibers of two inches in length are applied to the set premix and rolled in to insure a complete wetting of the chopped fibers without breaking the matrix. The chopped fibers can be applied and rolled into the layer of premix in several steps if desired to reach the necessary level of glass loading for the bottom layer.

The free space around the edges of the core and facing member and the mold side walls is preferably filled with a premix of wet cement and two percent by weight glass fibers one half inch in length, preferably with vibration to insure complete filling of the free space and wetting of scrim material positioned in the free space.

A premix of cement and two percent of one-half inch glass fibers is prepared by first mixing a wetting agent such as methyl cellulose with one half inch glass fibers and then mixing the wet fibers with a mixture of cement and sand with the amount of water adjusted to compensate for the wetting agent added to the one half inch glass fibers. The pre-wetted glass fibers are added up to two percent by weight based on the weight of the wet cement to the mixture of cement and sand and the entire mixture is mixed further for a period of approximately five minutes before being used. This prevents cat balling of the glass fibers which results from over mixing.

The premix of wet cement and two percent one half inch glass fibers is then cast into the bottom of the mold to a thickness of three eighths of an inch. Chopped and sprayed glass two inches in length is then applied in several passes to the top of the bottom layer and rolled in after each pass to insure complete wetting of the chopped two inch glass fibers without breaking the matrix that results from the chopping and spraying operation.

To aid in filling distribution and wetting of the fibers the mold can be vibrated intermittently during the application of the bottom and top layers and the filling of the free space between the mold side walls and the core.

The scrim material 14 can be positioned and pinned or secured in place by an adhesive.

The use of vibration insures complete filling and distribution and the avoidance of free spaces or parting lines. In curing the wet shell surrounding the foam cores 10, the cement has a tendency to shrink and this places the fibers in the shell in tension around the rigid foam core and the facing member which resists the shrinking effect of the cement. The nature of the fiber reinforced cement shell is such that it is self supporting which means that it can be removed from the mold within a very short period after casting the shell about the cores 10. Periods of an hour or more have been found to be sufficient before removing the partially cured module from the mold and curing is completed by keeping the module wet for periods of up to three to five days.

After fabrication of the module is complete the cement is allowed to cure under ambiant conditions or preferably in a steam heated curing enclosure. Curing can also be accelerated using hot wet cement made with water at about 122°-200° F. Once the cement is cured the composite module is removed from the mold and is ready for use.

The composite module of the invention can be used and installed in the same manner as conventional building modules such as pre-cast curtain-wall panels but because of the great reduction in weight simplified installation procedures are possible. Because of the greatly improved insulating and water vapor barrier properties the modules of the invention, no further steps have to be taken to insure these properties as is the case with conventional building modules.

In roof deck installations or curtain-wall installations, a room temperature curing elastomer such as a silicone elastomer can be used for edge-to-edge bonding between adjacent modules and the entire installation can be provided with an overcoating of a suitable elastomer. This provides for a shock resistant installation which can also compensate for later movement of a structure for example as a building settles after construction. The edges of the modules according to the invention can also be provided with one or more semi-circular longitudinal grooves to facilitate the use of flexible bead material made for example from synthetic polymer foams such as polyethylene positioned between adjacent modules to provide sealing against moisture and air.

Typical properties of commercially available rigid urethane polymer foams are set forth in the following table:

TYPICAL RIGID URETHANE FOAM PROPERTIES

| Density lb./cu.ft. Astm D 1622 | Compressive Strength psi Astm D 1621 | Compressive Modulus psi Astm D 1621 | Shear Strength psi | Shear Modulus psi |
|---|---|---|---|---|
| 1.5-2.0 | 20-60 | 400-2000 | 20-50 | 250-550 |
| 2.1-30 | 35-95 | 800-3500 | 30-70 | 350-800 |
| 3.1-45 | 50-185 | 1500-6000 | 45-125 | 500-1300 |
| 4.6-70 | 100-350 | 3800-12,000 | 75-180 | 850-2000 |

What is claimed is:

1. A method for making composite building modules comprising:

a. forming a bottom layer of fiber reinforced wet cementitious material;

b. forming a core by placing at least two rigid hollow foam box members each comprising a hollow tubular central portion and two flat end covers connected thereto side-by-side in a single layer on the bottom layer with all the adjoining edges forming at least one continuous channel completely around the core solely at the exterior thereof; and c. encapsulating the core in a fiber reinforced wet cementitious shell by depositing fibers and cementitious material around the sides of the core members and on the top thereof, filling each channel forming a rib completely around the interior of the cementitious shell.

2. A method according to claim 1, further comprising inserting lifting inserts into the top layer for effecting the lifting of the module by external lifting means.

3. A method according to claim 1, wherein the boxes are provided by connecting together individual planar foam members.

4. A method according to claim 1, wherein the boxes are connected by wrapping scrim material therearound.

5. A method according to claim 1, wherein the boxes are connected by tying bands therearound.

6. A method according to claim 1, wherein the boxes are connected by interlocking the adjoining sides.

7. A method according to claim 6, wherein the boxes comprise hollow rectangular solids having male and female interlocking elements on opposite longitudinal sides thereof.

8. A method according to claim 1, wherein the bottom layer is formed by providing a mold having bottom and side walls and depositing a layer of wet cementitious material and premixed fibers in the bottom of the mold.

9. A method according to claim 8, further comprising distributing lengths of fiber longer than the premixed fibers in the bottom layer.

10. A method according to claim 9, wherein the distributing step is carried out while vibrating the mold.

11. A method according to claim 10, wherein the boxes are wrapped in scrim material.

12. A composite building module comprising:

a. a core comprising at least two rigid hollow foam box members each comprising a hollow tubular central portion and two flat end covers connected thereto disposed side-by-side in a single layer and each including channel forming means at all adjoining edges forming at least one continuous channel completely around the core solely at the exterior thereof when the cores are disposed side-by-side;

b. means connecting the cores to maintaining same in the side-by-side relationship; and c. a fiber reinforced cementitious shell encapsulating the core and filling in each channel defining a rib completely around the interior of the shell.

13. A module according to claim 12, wherein the cores are hollow rectangular solids.

14. A module according to claim 12, wherein the connecting means comprises scrim material wrapped around the boxes.

15. A module according to claim 12, wherein the connecting means comprises bands tied around the boxes.

16. A module according to claim 12, wherein the connecting means for each box comprises a male interlocking element on one side and a female interlocking element on the opposite side configured to interlock with the male interlocking element on the adjoining box.

17. A module according to claim 12, wherein the channel forming means comprises a bevel on the adjoinable edges having one of a concave, slanted or stepped cross-section.

18. A module according to claim 16, wherein the male and female interlocking elements have one of a rectangle or semicircular cross-section.

19. A module according to claim 12, further comprising a plurality of lifting inserts each having a portion thereof embedded in the top layer of the shell.

20. A module according to claim 19, wherein each lifting member comprises an internally threaded portion having the top thereof flush with the outer surface of the shell and a plurality of load bearing arms embedded in the shell and attached to threaded portion and projecting therefrom.

21. A module according to claim 19, wherein each lifting insert comprises an I-shaped member and means defining a semi-spherical indent in the shell, wherein the lower portion of the member is embedded in the shell and the upper portion thereof projects into the indent.

* * * * *